United States Patent [19]

Smith et al.

[11] Patent Number: 4,988,664

[45] Date of Patent: Jan. 29, 1991

[54] THERMAL TRANSFER IMAGING USING ALKYLCARBONYLAMINO-ANTHRAQUINONE DYES

[75] Inventors: Terrance P. Smith; Krzysztof A. Zaklika; Susan K. Jongewaard; Louis M. Leichter, all of St. Paul, Minn.

[73] Assignee: Minnesota Mining and Manufacturing Company, St. Paul, Minn.

[21] Appl. No.: 384,770

[22] Filed: Jul. 21, 1989

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 3,484,342 | 8/1966 | Blake et al. | 204/18 |
| 3,617,173 | 11/1971 | Hilldreth et al. | 8/39 |
| 4,201,821 | 5/1980 | Fromson et al. | 428/203 |
| 4,369,038 | 1/1983 | Mehl | 8/471 |
| 4,682,983 | 7/1987 | Mehl | 8/468 |
| 4,808,568 | 2/1989 | Gregory et al. | 503/227 |

FOREIGN PATENT DOCUMENTS

| | | | |
|---|---|---|---|
| 53-37942 | 11/1973 | Japan | 503/227 |
| 51-40197 | 2/1975 | Japan | 503/227 |
| 0172591 | 9/1985 | Japan | 503/227 |
| 1424203 | 2/1976 | United Kingdom | 503/227 |

OTHER PUBLICATIONS

*Chemistry in Britain,* "Electronic Photography-The Future", Peter Gregory, Jan. 1989, pp. 47-50.

*Chemical Processing of Synthetic Fibers and Blends,* K. V. Datye and A. A. Vaidya, 1984, John Wiley and Sons, Chapter 15, Transfer Printing, pp. 396-416.

*Primary Examiner*—Bruce H. Hess

*Attorney, Agent, or Firm*—Donald M. Sell; Walter N. Kirn; Mark A. Litman

[57] ABSTRACT

Alkycarbonylaminoanthraquinones are useful for thermal dye transfer imaging when employed in dye donor sheets. These give images having excellent light and heat fastness.

12 Claims, No Drawings

THERMAL TRANSFER IMAGING USING ALKYLCARBONYLAMINO-ANTHRAQUINONE DYES

BACKGROUND OF THE INVENTION

CROSS-REFERENCE TO RELATED CASES

Some of the dyes included in the claims of the present case are included in examples of eutectic combinations of dyes for thermal imaging in 3M patent application Ser. No. 193,947 filed on May 13, 1988.

FIELD OF INVENTION

This invention relates to thermal imaging and, more particularly, to anthraquinone dyes bearing alkylcarbonylamino substituents which are useful for thermal dye transfer imaging.

BACKGROUND OF THE ART

The term thermal printing covers two main technology areas. In thermal transfer printing of textiles, a donor sheet is coated with a pattern of one or more dyes, contacted with the fabric to be printed, and heat is uniformly administered, sometimes with concomitant application of a vacuum. The transfer process has been much studied, and it is generally accepted that the dyes are transferred by sublimation in the vapor phase. Pertinent references include: C. J. Bent et al., *J. Soc. Dyers Colour.*, 85, 606 (1969); J. Griffiths and F. Jones, *ibid.*, 93, 176 (1977); J. Aihara et al., *Am. Dyest. Rep.*, 64, 46 (1975); C. E. Vellins in "The Chemistry of Synthetic Dyes", K. Venkataraman, ed., Vol. VIII, p191, Academic Press, New York, 1978.

The other area covered by the term thermal printing is thermal imaging, where heat is applied in an imagewise fashion to a donor sheet in contact with a suitable receptor sheet to form a colored image on the receptor. In one embodiment of thermal imaging, termed thermal mass transfer printing, as described for instance in U.S. Pat. No. 3,898,086, the donor sheet comprises a colorant dispersed in a wax-containing coating. On the application of heat, the construction melts or is softened and a portion of the colored donor coating transfers to the receptor. Despite problems with transparency, pigments are generally the colorants of choice in order to provide sufficient light fastness of the colored image on the receptor. Another embodiment is termed variously thermal dye transfer imaging or recording, or dye diffusion thermal transfer. In this embodiment, the donor sheet comprises a dye in a binder. On imagewise application of heat, the dye, but not the binder, is transferred to the receptor sheet. A recent review has described the transfer mechanism as a "melt state" diffusion process quite distinct from the sublimation attending textile printing. (See: P. Gregory, *Chem. Brit.*, 25, 47 (1989)).

This same review emphasizes the great difficulty of developing dyes suitable for diffusive thermal transfer, stating "it is significant that of the one million or so dyes available in the world, none were fully satisfactory". Among the failings of these dyes are inadequate light and heat fastness of the image and insufficient solubility of dyes for coating in the donor sheet. As has been noted previously, light fastness is also a problem in mass transfer imaging systems. In fact, achieving adequate light fastness is probably the single biggest challenge in these constructions. In large measure this is the result of the diffusive thermal transfer dye image being a surface coating a few microns thick. The dye is thus readily susceptible to photooxidative degradation. In contrast, textile fibers, which are 100 times thicker, are uniformly dyed throughout their depth, so that fading in the first few microns at the surface is of little practical importance. In consequence, it is common to find that dyes showing good light fastness in textile printing exhibit very poor photostablity in diffusive thermal transfer imaging (see e g., U.S. Pat. No. 4,808,568), and there remains a strong need for improved dyes for the latter application.

It now has been found that anthraquinone dyes bearing alkylcarbonylamino groups can be used beneficially when applied to thermal dye transfer imaging. When these dyes are used in dye donor constructions, the resultant transferred images exhibit improved light and heat fastness over comparable materials known in the art. This is surprising in view of the reference to "... the relatively low light fastness of the yellow acylaminoanthraquinones ... " in a standard work (H. S. Bien et al., in "Ullmann's Encyclopedia of Industrial Chemistry", 5th ed., vol. A2, p355,(1985)), and even more so considering the absence of aroyl groups often associated with increased light fastness. In the preferred embodiment of the invention, these alkylcarbonylaminoanthraquinones additionally offer improved solubility in the hydrocarbon-based solvents required for coating of dye donor constructions.

Carbonylaminoanthraquinones known in the thermal printing art are predominantly aroylamino derivatives. Frequently, auxochromic groups such as amino, alkylamino, arylamino, hydroxy and alkoxy are additionally present on the anthraquinone nucleus. Thus, 1,5-bis-(benzoylamino)anthraquinone is disclosed in U.S. Pat. No. 4,042,320 which provides aqueous, stable, highly concentrated, finely dispersed, flowable dispersions of water-insoluble dyes suitable for the production of printing pastes. The same compound is mentioned in U.S. Pat. No. 4,205,991, which claims printing inks formulated using the aforementioned dye dispersions. The use of these inks for thermal printing of textiles is discussed, suitable dyestuffs being those which are converted into the vapor phase to the extent of at least 60% in less than 60 seconds at a temperature of 150 to 220° C. International Pat. No. WO 83/00235 claims an electrostatic toner comprising magnetic particles which are coated with binder, the binder containing an amount of vaporizable or sublimable colorant. Said colorant is characterized as one which passes into the vapor phase to the extent of at least 60% in 30 seconds at 210° C and 100 mbar (about 0.1 atm), but less than 50% under the same time and temperature conditions at atmospheric pressure. The toned image may be used as a transfer sheet for thermal printing of cotton fibers swollen with polyethylene glycol. Dyes mentioned generally, among others, are aroylaminoanthraquinones; specific mention is made of 1-benzoylamino-4-(4'-butylanilino)anthraquinone. U.S. Pat. No. 4,682,983 claims a transfer sheet for heat transfer printing of textile materials which contain cellulosic fibers pretreated for swelling, said sheet comprising a flexible substrate coated with a release layer to which is applied a dyestuff coating or design. The dyestuff coating is characterized as a mixture of a binder and at least one disperse or vat dyestuff. This dyestuff has further additional characteristics: it does not "sublimate" in conventional heat transfer printing; it has an optical density not exceeding 0.3 as a saturated solution in boiling 0.1 molar aqueous sodium carbonate; it is transferred at no more than 40% by weight under conventional transfer conditions (200° C. 30 seconds, normal atmospheric pressure) and with relatively low contact pressure (5 kPa); it is transferred more than 60% by weight under high contact pressure (50 kPa) at 230° C for 30 seconds at a reduced atmospheric pressure of 10,000 Pa (about 0.1 atm). Among other suitable dyes, there are disclosed 1-benzoylaminoanthraquinone and its 4-, 5- or 8-substituted arylamino derivatives. Similarly, U.S. Pat. No. 4,369,038 claims auxiliary printing supports containing dyes vaporizing below 320° C, further characterized by their transfer properties to cotton swollen with polyethylene glycol at 50–120 mbar (i.e., about 0.05 to 0.12 atm) and at atmospheric pressure. The arylamino-substituted dyes disclosed in U.S. Pat. No. 4,682,983 are claimed in this patent. Also mentioned are: 1-benzoylamino-4-methoxyanthraquinone, 1,4- and 1,5-bis(aroylamino)anthraquinones and 1,4- and 1,5-bis(butyrylamino)anthraquinones. European Pat. No. 20292 Al describes another auxiliary support for the thermal printing of textiles, characterized by porosity or perforations permitting a specified air flow, and coated with a pattern of dyes to be transferred to the fabric. The dyes are specified as those which volatilize without significant decomposition below 310° C., and whose volatility is less than that of the least volatile of the colorants used for classical printing by transfer in the gas phase. Among other dyes, the dyes of U.S. Pat. No. 4,682,983 along with 1-amino-2-methoxy-4-aroylaminoanthraquinones are described as suited to this application. 1-Aminoanthraquinones having 4-, 5- or 8-aroylamino substituents are claimed in British Pat. No. 1,556,119 as dyes subliming below 240° C and used in a temporary carrier for thermal printing. The same dyes, along with 1-amino-4-formamido-, acetamido- or propionamidoanthraquinones are claimed for a similar purpose in Belgian Pat. No. 858,367. U.S. Pat. No. 3,632,291 claims a transfer printing process utilizing reactive dyes subliming below 240° C. Formula 2 of Example 6 of the latter patent is clearly erroneous, but is probably intended to represent 1-chloroacetylamino-4-hydroxy-5-chloroanthraquinone. British Pat. No. 1,424,203 claims a process for coloring hydrophobic fibers by transfer printing, employing anthraquinone dyes having a 1-NH(CO)G substituent along with other nuclear substitution. G is hydrogen, or an alkyl group preferably containing 1 to 4 carbon atoms. 1-acetylaminoanthraquinone is the only anthraquinone exemplified which does not have additional nuclear substitution, and the patent speaks of printing at reduced pressure to assist transfer of the colorant. Japanese Kokai No. 50-12388 describes transfer printing of cellulosic textiles pre-treated with a swelling agent of boiling point at or above 150° C using anthraquinone sublimation dyes. Included among the varied structures claimed are anthraquinones substituted solely with from one to four alkylcarbonylamino groups, wherein the alkyl moiety has from 1 to 8 carbon atoms. The transfer is accomplished by heating under pressure and is followed by a water wash post-treatment to remove the swelling agent. 1-n-decanoylamino-4-propionylaminoanthraquinone is the only explicit example of the above materials, and is itself outside the scope of the claims of that patent. In the abstract of Japanese Kokai No. 73-91387 the transfer printing of cellulose textiles is discussed, using sublimable reactive dyes having a molecular weight of 800 or less. Both azo and anthraquinone dyes are mentioned in the patent, along with reactive groups such as saturated and unsaturated acyl groups having alpha and/or beta halo substitution. There are, however, no explicit examples of materials pertinent to the present invention. Finally, U.S. Pat. Nos. 3,484,342 and 4,201,821 are both concerned with decorating anodized aluminum by a thermal printing process using dyes characterized by their sublimation properties. The former patent discusses anthraquinones with an amide group in the 1, 4, 5, or 8 positions as being suitable, referring to acetylamino and benzoylamino. The latter patent mentions the same materials, along with a structure which is obviously incorrect, but is presumably intended to be CI Violet 6, (i.e., 1-amino-4-(acetylamino)anthraquinone).

Although thermal printing of textiles bears a superficial resemblance to diffusive thermal dye imaging, in reality quite different processes with distinct properties and material requirements are involved. Thermal printing occurs by a sublimation process, so that substantial vapor pressure is a prime criterion for dye selection. In diffusive dye imaging, high vapor pressure of the dye contributes to undesirable thermal fugacity of the image. For the melt state diffusion process involved in this situation, melting point is instead a better basis for dye selection. Diffusive dye transfer is a high resolution dry imaging process in which dye from a uniform donor sheet is transferred in an imagewise fashion by differential heating to a very smooth receptor, using heated areas typically of 0.0001 square inches or less. In contrast, the thermal printing of textiles is of comparatively low resolution, involving contemporaneous transfer by uniform heating of dye from a patterned, shaped or masked donor sheet over areas of tens of square feet. The typical receptors printed in this manner are woven nor knitted fabrics and carpets. The distinct transfer mechanism allows such rough substrates to be used, while diffusive imaging, where receptors with a mean surface roughness of less than 10 microns are used, is unsuitable for these materials. Unlike diffusive thermal dye imaging, the transfer printing process is not always a dry process; some fabrics or dyes require pre-swelling of the receptor with a solvent or a steam post-treatment for dye fixation. Though the transfer temperatures for the two processes can be similar (180 to 220° C), diffusive dye transfer generally operates at somewhat higher temperatures. However, in a manner strikingly reflective of the differences in mechanism involved, diffusive dye transfer involves times of around 5 msec, whereas thermal printing normally requires times of 15 to 60 sec. In accord with the sublimation process involved, thermal printing often benefits from reduced atmospheric pressure or from flow of heated gas through the donor sheet. Thermal printing is a technology developed for coloring of textiles and is used to apply uniformly colored areas of a predetermined pattern to rough substrates. In contradistinction, diffusive dye transfer is a technology intended for high quality imaging, typically from electronic sources. Here, a broad color gamut is built with multiple images from donors of the three primary colors onto a smooth receptor. The different transfer mechanism allows the requirement for grey scale capability to be fulfilled, since the amount of dye transferred is proportional to the heat energy applied. In thermal printing grey scale capability is expressly shunned, because sensitivity of transfer to temperature decreases process latitude and dyeing reproducibility.

In the cited art, the printing is done under uniform heating, using conditions far removed from those which apply to imagewise diffusive dye transfer. The language of the cited patents clearly indicates a sublimation process is being attempted. Swelling of the fiber to be printed, or the presence of an aluminium oxide surface may be an additional requirement. The majority of the dyes disclosed are aroylaminoanthraquinones outside the scope of this invention. Where alkanoylaminoanthraquinones are disclosed, additional auxochromic groups are usually present, so that the materials are again beyond the scope of this invention. Only one patent in the thermal printing art discusses materials within the preferred embodiment of this invention. Since this textile printing art involves the use of sublimation dyes in conjunction with receptors requiring both pre- and post-treatment with solvents under conditions quite distinct from dry diffusive thermal dye transfer imaging, that art is not directly pertinent to the present invention. Moreover, as has been previously stated, suitability for thermal printing of textiles is no indicator of the acceptability of a dye for diffusive dye thermal transfer.

SUMMARY OF THE INVENTION

This invention relates to novel thermal dye transfer constructions, in particular dye donor elements.

This invention further relates to donor elements based on alkylcarbonylamino-substituted anthraquinones.

This invention still further relates to the provision of dye donor elements comprising dye and binder compositions on non-porous substrates which, when imaged, give rise to dye images of excellent light and heat fastness.

This invention provides thermal dye transfer compositions which, when heated in an imagewise fashion, result in the transfer of dye to a receptor sheet. The thermal dye transfer compositions comprise at least one anthraquinone dye wherein the nuclear aromatic carbon atoms are substituted with at least one and up to four alkylcarbonylamino groups in a position peri to the anthraquinone carbonyl group, the anthraquinone nucleus being free of other substituents. It is preferred that the dye be free of ionic, water-solubilizing groups such as $SO_3H$ and $CO_2H$. More particularly the anthraquinone dye is selected from those with the general structure:

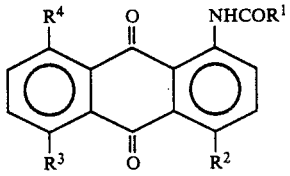

where $R^1$ is selected from linear, branched and cyclic alkyl groups, preferably of 1 to 20 carbon atoms, $R^2$, $R^3$, and $R^4$ are independently selected from hydrogen and R(CO)NH—, wherein the groups R are independently selected from linear, branched and cyclic alkyl groups (preferably of 1 to 20 carbon atoms), and said alkyl groups R and $R^1$ may be substituted with groups selected from aryl; heteroaryl; fluoro; chloro; bromo; cyano; carbonyl and its derivatives, such as aldehyde, ketone, ester and amide; sulfonyl and its derivatives; alkoxy; aryloxy; thioalkyl; thioaryl; amino; and alkyl and aryl N-substituted derivatives of amino, with the proviso that at least one of R and $R^1$ contains a total of four or more carbon atoms. $R^1$ is preferably alkyl (free of vinyl or halogen substitution) of 1 to 12 carbon atoms.

As is well understood in this technical area, a large degree of substitution is not only tolerated, but is often advisable. As a means of simplifying the discussion and recitation of these groups, the terms "group" and "moiety" are used to differentiate between chemical species that allow for substitution or which may be substituted. For example, the phrase "alkyl group" is intended to include not only pure hydrocarbon alkyl chains such as methyl, ethyl, octyl, cyclo-hexyl, isooctyl, tert-butyl, and the like, but also such alkyl chains bearing such conventional substitutents in the art such as hydroxyl, alkoxy, phenyl, halo (F, Cl, Br, I), cyano, nitro, amino, etc. The phrase "alkyl moiety", on the other hand, is limited to the inclusion of only pure hydrocarbon alkyl chains such as methyl, ethyl, propyl, cyclohexyl, isooctyl, tert-butyl, and the like.

The donor element may have a variety of structures, including a self-supporting layer or a laminate or coating on various substrates, and may be used in a number of different imaging processes, including imaging with thermal print heads and with lasers. The dye is present in the donor construction along with a polymer binder, in amounts up to 99% by weight, but more typically from about 90% to 15% by weight, and preferably from 70% to 40% by weight in multilayer constructions. A self-supporting layer may contain 20% by weight of binder, and preferably as much as 40% by weight of binder.

The dye donor constructions of this invention provide transferred dye images which have excellent heat and light fastness.

DETAILED DESCRIPTION OF THE INVENTION

The process of dye diffusion thermal transfer consists essentially of contacting a dye donor sheet with a suitable receptor sheet and applying heat in an imagewise fashion to transfer the dye to the receptor. Generally the transfer involves temperatures up to 400° C and times of a few milliseconds. In addition to providing an image of acceptable density and of correct color, the dye must provide good light fastness and heat stability in the image. It is particularly desirable that the dye transfers in proportion to the heat applied, so that a good grey scale of coloration can be obtained.

The invention provides a thermal dye transfer donor construction for providing stable transferred dye images, comprising a thermal dye transfer composition containing at least one anthraquinone dye, the anthraquinone nuclear aromatic carbon atoms of which are substituted with at least one and up to four alkylcarbonylamino groups in a position peri to the anthraquinone carbonyl group, the anthraquinone nucleus being free of other substituents. The alkyl groups present in the alkylcarbonylamino groups may be linear, branched or cyclic. These alkyl groups may be additionally substituted with groups such as the halogens F, Cl, and Br; cyano; carbonyl and its derivatives such as aldehyde, ketone, ester and amide; sulfonyl and its derivatives; alkoxy; aryloxy; thioalkyl; thioaryl; and amino and its alkyl and aryl N-substituted derivatives. It is preferred, however, that the dye be free of ionic or ionizable, water-solubilizing groups such as $SO_3H$ and $CO_2H$ and their salts. At least one of said alkyl or substituted alkyl groups must contain a total of four or more carbon atoms. In the case of symmetrically substituted anthraquinones (i.e., 1,5- and 1,4,5,8-derivatives) it is preferred that not all the alkylcarbonylamino groups have the same structure.

In the case of thermal printing by sublimation transfer it is generally desired to minimize the molecular weight of the dye in order to maintain volatility. Substituent size is, therefore, kept small. In contrast, for diffusive dye transfer imaging the melting point of the dye appears to be a more important criterion. A lowered melting point is often associated with improved transfer efficiency and with a higher image density. Larger substituents generally reduce the melting point in a beneficial way. It is also often the case that larger substituents increase the solubility of the dye. High solubility typically reduces undesirable crystallinity of the dye in the donor construction. A further advantage of larger substituents in diffusive dye imaging is that, if dye volatility is reduced, the image is more resistant to degradation by sublimative loss of dye. Table 1 illustrates the differences in melting and solubility behavior for the aryl- and short chain alkylcarbonylaminoanthraquinones used in thermal printing on the one hand, and the larger chain alkylcarbonylaminoanthraquinones of the present invention on the other.

TABLE 1

| Substitution | mp (°C.) | solubility |
|---|---|---|
| Mono-substitution | | |
| 1-NHCOPh | 248 | poor |
| 1-NHCOCH$_3$ | 220 | poor |
| 1-NHCOCH$_2$Cl | 217 | poor |
| 1-NHCOCH$_2$I | 208 | |
| 1-NHCOCCl$_3$ | 233 | |
| 1-NHCOCBr$_3$ | 244 | |
| 1-NHCOC$_2$H$_5$ | 176 | |
| 1-NHCO(CH$_2$)$_2$CH$_3$ | 163 | |
| 1-NHCOCH(CH$_3$)$_2$ | 202 | poor |
| 1-NHCOCH(C$_2$H$_5$)(CH$_2$)$_3$CH$_3$ | 150 | good |
| 1-NHCO(CH$_2$)$_5$CH$_3$ | 133 | good |
| 1-NHCO(CH$_2$)$_{10}$CH$_3$ | 128 | good |
| 1-NHCO(CH$_2$)$_{14}$CH$_3$ | 129 | good |
| 1-NHCO(CH$_2$)$_{16}$CH$_3$ | 131 | |
| 1,4-Di-substitution | | |
| 1,4-bis(NHCOPh) | 286 | |
| 1,4-bis(NHCOCH$_3$) | 271 | |
| 1,4-bis(NHCOCH$_2$Cl) | 282–285 (decomp.) | |
| 1,4-bis(NHCOCH$_2$CH$_2$Cl) | 176–177 (sublim.) | |
| 1,4-bis(NHCOCH$_2$NHCH$_2$CH$_2$OH) | 263–265 (decomp.) | |
| 1,4-bis(NHCO(CH$_2$)$_4$CH$_3$) | 177 | |
| 1,4-bis(NHCO(CH$_2$)$_{14}$CH$_3$) | 113 | |
| 1,4-bis(NHCO(CH$_2$)$_{16}$CH$_3$) | 122 | |
| 1-NHCOCH$_3$-4-NHCO(CH$_2$)$_{10}$CH$_3$ | 130 | |
| 1-NHCOCH$_3$-4-NHCO(CH$_2$)$_{14}$CH$_3$ | 122 | |
| 1-NHCOCH$_3$-4-NHCO(CH$_2$)$_{16}$CH$_3$ | 99 | |
| 1,5-Di-substitution | | |
| 1,5-bis(NHCOPh) | 403 | poor |
| 1,5-bis(NHCOCH$_3$) | 318 | poor |
| 1,5-bis(NHCOCH$_2$Cl) | 327–335 | |
| 1,5-bis(NHCOCH$_2$CH$_3$) | 271 | |
| 1,5-bis(NHCOCH$_2$N(CH$_2$CH$_3$)$_2$) | 231–235 | |
| 1,5-bis(NHCOCH$_2$N(CH$_2$CH$_2$CH$_3$)$_2$) | 212–217 | |
| 1,5-bis(NHCOCH$_2$N(CH$_2$CH$_2$CH$_2$CH$_3$)$_2$) | 134–139 | |
| 1,5-bis(NHCO(CH$_2$)$_3$CH$_3$) | 183 | |
| 1,5-bis(NHCO(CH$_2$)$_6$CH$_3$) | 152 | |
| 1,5-bis(NHCO(CH$_2$)$_{10}$CH$_3$) | 149 | |
| 1,5-bis(NHCO(CH$_2$)$_{14}$CH$_3$) | 142 | |
| 1,5-bis(NHCO(CH$_2$)$_{16}$CH$_3$) | 145 | |
| 1-NHCOCH$_3$-5-NHCO(CH$_2$)$_{10}$CH$_3$ | 156 | |
| 1-NHCOCH$_3$-5-NHCO(CH$_2$)$_{14}$CH$_3$ | 168 | |
| 1-NHCOCH$_3$-5-NHCO(CH$_2$)$_{16}$CH$_3$ | 143 | |
| 1,8-Di-substitution | | |
| 1,8-bis(NHCOPh) | 317 | poor |
| 1,8-bis(NHCOCH$_3$) | 284 | poor |
| 1,8-bis(NHCO(CH$_2$)$_{16}$CH$_3$) | 121 | |
| 1,4,5,8-Tetra-substitution | | |
| 1,4,5,8-tetrakis(NHCOPh) | 390 | |
| 1,4,5,8-tetrakis(NHCOCH$_3$) | 315–320 | |
| 1,4,5,8-tetrakis(NHCO(CH$_2$)$_8$CH$_3$) | 206 | |

The table shows that a melting point below about 200° C. together with good solubility may be achieved with alkylcarbonylaminoanthraquinones in which the alkyl or substituted alkyl group contains four or more carbon atoms. The entry for 1,4-bis(2'-chloropropionylamino)anthraquinone illustrates the undesirably high vapor pressure exhibited by alkylcarbonylaminoanthraquinones with short alkyl chains. Smaller alkyl groups from 1 to 3 carbon atoms may be used if there is at least one other alkyl carbonylamino group in which the alkyl or substituted alkyl group contains at least four carbon atoms. Materials such as these have been found effective in donor constructions for thermal transfer imaging, of which examples are given below.

The dye donor sheet for this process comprises a dye ink coated on suitable (non-porous) substrate, though a self-sustaining dye film is also a possibility. The carrier sheet is preferably flexible, but may be rigid if the receptor layer is sufficiently flexible and/or conformable. The substrate, if any, may thus be glass, ceramic, metal, metal oxide, fibrous materials, paper, polymers, resins, and mixtures or layers of these materials. For backside thermal exposure with a thermal print head, example substrates include polyester, polyimide, polyamide, polyacrylate, polyalkylene and cellulosic films, and paper, especially the uniform high-quality paper known as condenser paper. It may be desirable to apply a backsize to the substrate on the side away from the dye to protect it from the heat source or to prevent sticking to the thermal element. The thickness of the resultant substrate may vary within wide limits depending on its thermal properties, but is generally below 50 microns, preferably below 12 microns (e.g., 0.5 to 12 microns), and more preferably less than 10 microns. If a front thermal exposure is used, for instance when a laser irradiates the dye through a transparent receptor sheet, the substrate may be of arbitrary thickness. The term "non-porous" used in the practice of the present invention means that when the donor sheet is heated under conditions of transfer, less than 50% by weight of dye in the heated areas will penetrate further into the carrier sheet in 1/1000 sec while the transfer surface is in contact with a receptor sheet.

The dye ink applied to the donor sheet comprises a carbonylamino-substituted anthraquinone dye as defined above, and a suitable binder. Other additives such as plasticizers, stabilizers or surfactants may also be present, as is known in the art Suitable binders are polymeric materials such as: polyvinyl chloride and its chlorinated derivatives; polyesters; celluloses, such as cellulose acetate, cellulose acetate butyrate, ethyl cellulose and the like; epoxy resins; acrylates, such as polymethyl methacrylate; vinyl resins, such as polyvinyl acetate, polyvinyl butyral, polyvinyl pyrrolidone and polyvinyl alcohol; polyurethanes; polysiloxanes; copolymers, such as those derived from polyacrylates or polyalkylene materials; and blends or mixtures of these various polymers. Chlorinated polyvinyl chloride has been found especially useful, particularly when used in mixtures with polyesters or acrylates. The dye may be present in the binder in the dissolved state, or it may be dispersed with at least some crystalline dye present. In some cases as much as 99% by weight of dye may be used, but a more typical range could be about 90% to 15% by weight of dye. A preferred range is from 70% to 40% by weight of dye.

In general, it is desired to formulate the donor such that the dye, but substantially none of the donor element binder, is transferred to the receptor. The thermal transfer efficiency of these articles (percent ITE) tend to vary linearly with the applied voltage (applied to the heating means). However, in some cases valuable constructions can be prepared in which the dye along with a significant, or indeed major, portion of the binder is transferred in a mass transfer process.

The receptor sheet may be transparent, translucent or opaque. It may be a single layer or a laminate. Particularly useful constructions can be made when the receiving layer is applied to a transparent polyester film or to a paper substrate. The receptor sheet construction may comprise a wide variety of polymers or their mixtures. Suitable materials are similar to those outlined above for the binder of the donor sheet. Especially useful results can be obtained with receptors where the major component is chlorinated polyvinyl chloride. The receptor may additionally contain various additives, such as heat and light stabilizers or coating aids. While the exact nature of the receptor may influence the quality and fastness of the image, it has been found that the excellent stablity of the dyes of this invention is a property of the dye image itself and not of the receptor composition.

The alkanoylaminoanthraquinones have been known from the end of the last century, and the methods of preparing them are well known in the art. For example, aminoanthraquinones may be acylated with alkanecarboxylic acids, their anhydrides, amides, lactones or esters, or with alkanecarbonyl halides, optionally in the presence of an acid binding agent. Alternatively, a haloanthraquinone may be reacted with a carboxylic acid amide, preferably in the presence of a copper catalyst. When substituents are present in the alkyl portions of the alkylcarbonylamino groups, these may be introduced by modification of the alkylcarbonylaminoanthraquinone. However, it is generally preferable to introduce these substituents prior to the formation of the anthraquinone amide. Exemplary references to the synthesis of the dyes of this invention are: H. Roemer, *Ber.*, 15, 1791 (1882); E. Noelting and W. Wortmann, *Ber.*, 39, 637 (1906); R. Stolle et al., *J. prakt. Chem.*, 128, 1 (1930); K. Lauer and L-S. Yen, *J. prakt. Chem.*, 151, 49 (1938); R. D. Desai and R. N. Desai, *J. Indian Chem. Soc.*, 33, 559 (1956); S. Martelli et al., *J. Med. Chem.*, 31, 1956 (1988). The method of Desai and Desai is especially effective, and its application to the preparation of a compound of this invention is provided in Example 1.

EXAMPLES

Example 1

Preparation of 1-n-heptanoylaminoanthraquinone

Into a 250 ml round-bottom flask equipped with magnetic stirrer, condenser, heating mantle and nitrogen blanket, were placed 10.0 g of 1-aminoanthraquinone, 80 ml of nitrobenzene and 6.5 g of n-heptanoyl chloride. The solution was refluxed for 2.5 hours and cooled. Crude product was precipitated with methanol, filtered and dried. Chromatography on silica gel with toluene eluent afforded yellow 1-n-heptanoylaminoanthraquinone, melting at 133° C.

The performance of the dyes of this invention in diffusive thermal imaging systems is demonstrated in the following examples, with particular reference to image stability, especially with regard to light. These examples are intended to be illustrative, but not limiting. The dyes are useful and effective in a variety of other embodiments of thermal dye transfer known to those with skill in the art.

The following is a description of the various coating formulations referred to in the examples of this patent. All dye donor sheets were coated with a number 8 wire-wound coating rod (0.72 mil [0.018mm]wet thickness) onto 5.7 micron Teijin F24G thermal film, which is representative of a thin polyester film, and dried in a current of air at ambient temperature.

Donor sheet A

The donor sheet was made from the following formulation:

| | |
|---|---|
| 0.03 g | dye |
| 0.025 g | Goodrich Temprite TM 678 × 512 62.5% chlorinated polyvinyl chloride (CPVC) |
| 0.007 g | 60/40 blend of octadecyl acrylate and acrylic acid |
| 1.50 g | tetrahydrofuran |
| 0.10 g | 2-butanone |

Donor sheet B

The donor sheet was made for the following formulation:

| | |
|---|---|
| 0.06 g | dye |
| 0.04 g | Goodrich Temprite TM 678 × 512 62.5% CPVC |
| 0.01 g | 60/40 blend of octadecyl acrylate and acrylic acid |
| 0.005 g | Goodyear Vitel TM PE 200 polyester |
| 1.50 g | tetrahydrofuran |
| 0.10 g | 2-butanone |

Donor sheet C

The donor sheet was made from the following formulation:

| | |
|---|---|
| 0.06 g | dye |
| 0.04 g | Goodrich Temprite TM 678 × 512 62.5% CPVC |
| 0.007 g | 60/40 blend of octadecyl acrylate and acrylic acid |
| 0.003 g | Goodyear Vitel TM PE 200 polyester |
| 2.80 g | tetrahydrofuran |
| 0.15 g | 2-butanone |

Donor sheet D

The donor sheet was made from the following formulation:

| | |
|---|---|
| 0.09 g | dye |
| 0.075 g | Goodrich Temprite TM 623 × 536 67% CPVC |
| 0.13 g | Emery Plastolein TM 9776 polyester |

-continued

| | |
|---|---|
| 4.50 g | tetrahydrofuran |
| 0.13 g | 2-butanone |

Receptor Sheet A

The following receptor sheet formulation was coated with a number 8 wire-wound coating rod onto 4 mil polyethylene terephthalate film and dried in a current of warm air.

| | |
|---|---|
| 0.25 g | ICI 382ES bisphenol A fumarate polyester |
| 0.20 g | Goodrich Temprite TM 678 × 512 62.5% CPVC |
| 0.04 g | Shell Epon TM 1002 epoxy resin |
| 0.04 g | Goodyear Vitel TM PE 200 polyester |
| 0.05 g | 3M Fluorad TM FC 430 fluorocarbon surfactant |
| 0.015 g | Ciba-Geigy Tinuvin TM 328 UV stabilizer |
| 0.04 g | BASF Uvinul TM N539 UV stabilizer |
| 0.05 g | Ferro Therm-Check TM 1237 heat stabilizer |
| 0.08 g | Eastman Kodak DOBP TM 4-dodecyloxy-2-hydroxybenzophenone |
| 4.56 g | tetrahydrofuran |
| 1.85 g | 2-butanone |

Receptor Sheet B

This receptor was 3M Match-Print TM corona treated film base, with dye transfer to the treated side.

Receptor Sheet C

This receptor was Hitachi VY-S Video Print Paper TM, which was used as received, with dye transfer to the coated side.

Printer A

Thermal printer A used a Kyocera raised glaze thin film thermal print head with 8 dots/mm and 0.25 watts per dot. In normal imaging, the electrical energy varied from 2.64 to 6.43 joules/sq.cm, which corresponded to head voltages from 9 to 14 volts with a 4 msec pulse. Grey scale images were produced by using 32 electrical levels, produced by pulse width modulation.

Printer B

Thermal printer B used a Kyocera raised glaze thin film thermal print head with 8 dots/mm and 0.3 watts per dot. In normal imaging, the electrical energy varied from 0 to 10 joules/sq.cm, which corresponded to head volta9es from 0 to 20 volts with a 4 to 10 msec pulse.

Printer C

Thermal printer C used an OKI thin film, flat glaze thermal print head with 8 dots/mm and 0.27 watts per dot. In normal imaging, the electrical energy was 3 joules/sq.cm, administered with a 2.5 msec pulse. 32 electrical grey levels were available by pulse width modulation or by variation of applied voltage.

The photostability of transferred images produced with the alkylcarbonylaminoanthraquinone dyes of this invention is demonstrated in Examples 2 and 3. It is found to be excellent. Comparison of the results for 1,4-bis(1'-ethylhexanoylamino)anthraquinone in these two examples illustrates that the light fastness is associated with the dye irrespective of the dye receptor layer used. Example 4 compares a dye of this invention with a reference azo dye of Structure 1, and with an azopyridone dye (Structure 2) explicitly developed for dye diffusion thermal imaging as described in U.S. Pat. No. 4,808,568, and providing high light fastness. The test reveals that the image produced according to this invention is superior in light fastness to that made with either of the said reference dyes. A comparison of Examples 2 and 4 illustrates that the photostability of this image does not depend on the irradiation source.

Structure 1

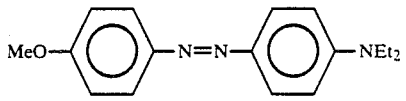

Structure 2

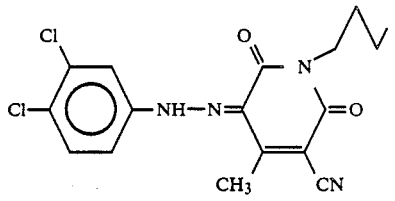

Example 2

The tabulated anthraquinone dyes were incorporated into donor sheets using formulation A and imaged onto receptor sheet A using printer B. The transferred images were then exposed in an Atlas UVICON TM at 350 nm and 50 degrees Centigrade for the indicated times. The change in (L,a,b) color coordinates, DELTA E, was determined. A DELTA E of less than 2.0 is not discernable with the human eye. The results are given below.

| Substitution | DELTA E values at 24 hr | DELTA E values at 48 hr |
|---|---|---|
| 1-(1'-ethylhexanoylamino) | 2.1 | 3.1 |
| 1,4-bis(1'-ethylhexanoylamino) | 1.2 | — |

Example 3

The tabulated anthraquinone dyes were incorporated into donor sheets using formulation A and imaged onto receptor sheet C using printer B. The transferred images were then evaluated as in Example 2, with the results below.

| Substitution | DELTA E values at 24 hr | DELTA E values at 48 hr |
|---|---|---|
| 1,5-bis(1'-ethylhexanoylamino) | 0.9 | 0.9 |
| 1,4-bis(1'-ethylhexanoylamino) | 1.1 | 2.8 |

Example 4

The tabulated dyes were incorporated into donor sheets using formulation C and imaged onto receptor sheet A using printer A. The transferred images on this transparent receptor were exposed for 24 hours on a 360 watt 3M Model 213 overhead projector and the percent change in image optical density was measured.

| Dye | % density loss |
|---|---|
| Structure 1 | 13 |
| Structure 2 | 6 |
| 1-(1'ethylhexanoylamino)- | 0 |

-continued

| Dye | % density loss |
|---|---|
| anthraquinone | |

In addition to providing good light fastness, the dyes of this invention also exhibit good thermal stability of the transferred image. This is often a problem in dye diffusion images. Example 5 illustrates the excellent results obtained.

Example 5

1,4-bis(1'-ethylhexanoylamino)anthraquinone was imaged as in Example 3 onto receptor C and held at 50° C. for the times indicated. DELTA E values were determined as tabulated below.

| Elapsed time (hr) | DELTA E |
|---|---|
| 24 | 0.6 |
| 48 | 1.3 |

An effective thermal dye imaging system must transfer dye in direct proportion to the heat input in order to provide for true grey scale capability. An indicator of transfer efficiency of the dye (ITE) was computed as the ratio, expressed as a percentage, of the reflection optical density of the transferred image to the reflection optical density of the donor sheet prior to imaging. The ITE as a function of energy input was then determined. Accordingly, 1-(1'-ethylhexanoylamino)anthraquinone was prepared in donor sheet B and imaged onto receptor A using printer A operated at various voltages The results showed the desirable good linearity of transfer with applied voltage. The peak transfer efficiency was high.

When 1-(1'-ethylhexanoylamino)anthraquinone and 1-n-heptanoylaminoanthraquinone were imaged from donor sheet D onto receptor B using printer C good linearity of transfer with voltage was again observed. Both dyes readily reproduced 29 steps of a 32 step grey scale. Under these imaging conditions the donor sheet was not exhausted and could be re-imaged. 1-isobutanoylaminoanthraquinone and 1,5-bis(-stearoylamino)anthraquinone were not fully soluble in donor formulation D and could not be tested.

What is claimed is:

1. A process for the thermal dye transfer of an image comprising placing a thermal dye transfer imaging element comprising a uniform layer of both a binder and an anthraquinone dye in contact with a receptor surface, said layer of both a binder and dye in contact with said receptor surface, imagewise heating areas of 0.0001 square inches or less of said layer with sufficient energy for a few milliseconds to transfer said dye to said receptor surface and thereby form an image, said layer of said thermal dye transfer dry imaging element being bound to a non-porous substrate having a total thickness of less than 50 microns and said dye having a melting point below 200° C. and a central nucleus of the general structure:

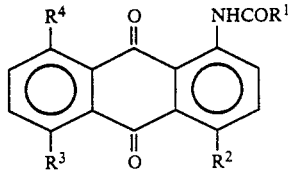

where $R^1$ is an alkyl group, $R^2$, $R^3$, and $R^4$ are independently selected from hydrogen and RCONH—, wherein the groups R are independently selected from alkyl groups, provided that at least one of the alkyl groups R and $R^1$ contains a total of at least 4 carbon atoms.

2. A process as recited in claim 1 wherein at least one of said alkyl groups R and $R^1$ independently contain at least 6 carbon atoms.

3. The process of claim 2 wherein at least one of $R^2$, and $R^3$ and $R^4$ are RCONH—.

4. The process of claim 3 wherein said substrate is from 0.5 to 12 microns thick.

5. The process of claim 2 wherein only one of $R^2$, and $R^3$ and $R^4$ are RCONH—.

6. The process of claim 5 wherein said substrate is from 0.5 to 12 microns thick.

7. The process of claim 2 wherein said substrate is from 0.5 to 12 microns thick.

8. The process of claim 1 wherein at least one of $R^2$, and $R^3$ and $R^4$ are RCONH—.

9. The process of claim 8 wherein said substrate is from 0.5 to 12 microns thick.

10. The process of claim 1 wherein only one of $R^2$, $R^3$ and $R^4$ are RCONH—.

11. The process of claim 10 wherein said substrate is from 0.5 to 12 microns thick.

12. The process of claim 1 wherein said substrate is from 0.5 to 12 microns thick.

* * * * *